US008793846B2

(12) United States Patent
d'Auriac

(10) Patent No.: US 8,793,846 B2
(45) Date of Patent: Aug. 5, 2014

(54) SYSTEMS FOR REMOVABLY SECURING A DISPLAY COMPONENT TO AN ACCESSORY OR ITEM OF CLOTHING

(76) Inventor: Paul-Philippe d'Auriac, Gardiner, NY (US)

( * ) Notice: Subject to any disclaimer, the term of this patent is extended or adjusted under 35 U.S.C. 154(b) by 1017 days.

(21) Appl. No.: 12/757,592

(22) Filed: Apr. 9, 2010

(65) Prior Publication Data

US 2011/0247201 A1 Oct. 13, 2011

(51) Int. Cl.
*H01F 7/00* (2006.01)
*A44C 5/18* (2006.01)

(52) U.S. Cl.
USPC ..... 24/303; 24/66.1; 29/592.1; 29/600; 292/251.5

(58) Field of Classification Search
USPC ..... 29/593.2, 600, 896; 24/303, 66.1; 428/900; 273/160; 383/119, 35, 95
See application file for complete search history.

(56) References Cited

U.S. PATENT DOCUMENTS

| | | | | |
|---|---|---|---|---|
| 5,367,891 | A * | 11/1994 | Furuyama | 24/303 |
| 5,664,298 | A * | 9/1997 | Nessar-Ivanovic | 24/303 |
| 5,806,346 | A * | 9/1998 | Schlinger et al. | 63/40 |
| 6,675,448 | B2 * | 1/2004 | Revel | 24/303 |
| 7,641,536 | B2 * | 1/2010 | Fildan et al. | 450/72 |
| 2002/0139142 | A1 * | 10/2002 | Marandola, Jr. | 63/22 |
| 2013/0042391 | A1 * | 2/2013 | Hill et al. | 2/244 |

* cited by examiner

*Primary Examiner* — Minh Trinh
(74) *Attorney, Agent, or Firm* — Edwards Wildman Palmer LLP; Scott D. Wofsy; Alicia J. Esposito

(57) ABSTRACT

A system for removably securing a component to a base. The system includes a plurality of attachment means, each having a first attachment mechanism fixedly secured to the base, and a second attachment mechanisms fixedly secured to the component. Each of the first attachment mechanisms is configured to correspond to, and engage with, one of the second attachment mechanisms to securely fasten the component to the base. The plurality of first attachment mechanisms and the plurality of second attachment mechanisms are configured such that a gap is formed between the component and the base, and a void is formed between the plurality of attachment means when the attachment mechanisms are engaged, to create a leverage point directly above the void that allows the attachment mechanisms to at least partially disengage and the component to be removed from the base when a force is applied to the leverage point.

2 Claims, 3 Drawing Sheets

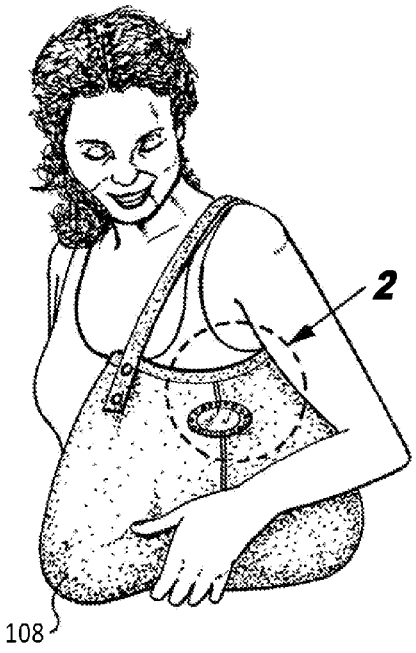
Fig. 1
Fig. 2
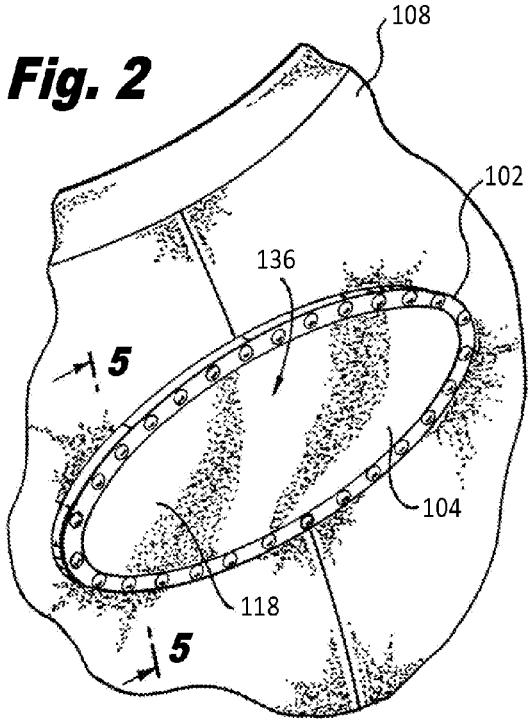
Fig. 3
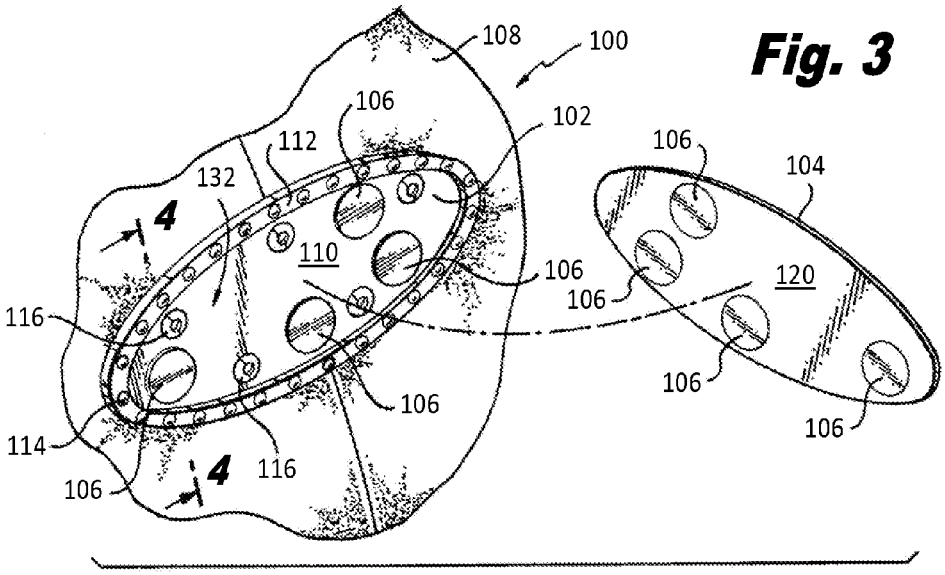

SYSTEMS FOR REMOVABLY SECURING A DISPLAY COMPONENT TO AN ACCESSORY OR ITEM OF CLOTHING

BACKGROUND OF THE INVENTION

1. Field of the Invention

The present invention relates to systems for removably securing a component to a base. More particularly, the present invention relates to a system for removably securing artwork or other display components to a base secured to an item of clothing or an accessory such as a handbag, a shoe, a piece of jewelry, or the like.

2. Description of Related Art

Fashion-conscious consumers are constantly seeking ways to stand out in a crowd and are eager to display the latest fashions in a way that fits the personality and tastes of the individual consumer. Traditional accessories such as purses and handbags, shoes, belts, necklaces, bracelets, and ear rings allow consumers to personalize and customize their look by mixing and matching each of the consumer's chosen accessories with other accessories and items of clothing.

However, conventional accessories and clothing items have generally allowed only a very limited degree of customization of the accessory or clothing item itself. For example, if a consumer is no longer enamored with a specific handbag, there is little that the consumer can do to change the look of the handbag, and the only option may be to purchase a new handbag. In addition, consumers increasingly desire to differentiate themselves from the crowd by displaying fashion accessories that are unique or that have special meaning to the individual consumer. At the same time, practicality requires that the accessories be durable and able to withstand the rigors of daily use without breaking, wearing down prematurely, or falling off.

Accordingly, there is a need for a system that allows customization of accessories or other items by securely yet removably attaching a display component to a base that can be affixed to an accessory or item of clothing. There is also a need for a system that would allow the consumer to quickly change the look of an accessory or clothing item and would allow the consumer to securely display unique and personalized artwork without worrying that the display item would fall off or easily be dislodged from its base. The present invention meets these needs.

SUMMARY OF THE INVENTION

The subject invention is directed to a system for securely but removably securing a display component to a base. Various aspects of the invention will become more readily apparent to those having ordinary skill in the art from the following description taken in conjunction with the several drawings described below.

In one exemplary embodiment, the system comprises a base, a component configured to be removably attached to the base, and a plurality of attachment means, with each attachment means having a first attachment mechanism fixedly secured to the base, and a second attachment mechanisms fixedly secured to the component. Each of the first attachment mechanisms is configured to correspond to, and engage with, one of the second attachment mechanisms to securely fasten the component to the base. The plurality of first attachment mechanisms and the plurality of second attachment mechanisms are configured such that a gap is formed between the component and the base, and a void is formed between the plurality of attachment means when the attachment mechanisms are engaged, to create a leverage point directly above the void that allows the attachment mechanisms to at least partially disengage and the component to be removed from the base when a force is applied to the leverage point.

In another exemplary embodiment, the system comprises a base with a planar surface and a raised lip portion surrounding the periphery of the planar surface, a component configured to nest securely within the base and to be surrounded by the raised lip portion, a first set of permanent magnets fixedly secured to the base, and a second set of permanent magnets fixedly secured to the component. Each of the magnets in the second set is configured to correspond to one of the magnets in the first set. An upper face of each of the permanent magnets is positioned a first predetermined distance from the planar surface of the base, and a lower face of each of the magnets in the second set is positioned a second predetermined distance from the component and configured to attract the upper face of the corresponding magnet in the first set to removably secure the component to the base. The first set of magnets and the second set of magnets are configured such that a gap is formed between the component and the planar surface of the base to create a leverage point directly above the gap that allows the magnets to at least partially disengage and the component to be removed from the base when a downward force is applied to the leverage point.

In yet another exemplary embodiment, the system includes a base having a planar surface and a raised lip portion surrounding the periphery of the planar surface, a component configured to nest securely within the base surrounded by the raised lip portion, a first set of permanent magnets fixedly secured to the base in a raised position, and a second set of permanent magnets fixedly secured to the removable component in a raised position in a configuration corresponding to the first set of permanent magnets. An upper face of each of the permanent magnets in the first set of magnets has a first polarity and is positioned below the raised lip portion of the base, and a lower face of each of the magnets in the second set has a second polarity which is opposite the first polarity such that the lower face of each magnet in the first set is configured to attract the upper face of the corresponding magnet in the first set of magnets to removably secure the component to the base. The configuration of the first and the second sets of magnets creates a gap such that depressing the component in the area corresponding to the gap creates a fulcrum allowing the corresponding magnets to at least partially disengage and the component, allowing the component to be removed from the base.

BRIEF DESCRIPTION OF THE DRAWINGS

So that those skilled in the art to which the subject invention pertains will readily understand how to implement the devices and systems for removably securing a component to a base without undue experimentation, preferred embodiments of the methods and systems will be described in detail below with reference to the following figures:

FIG. 1 illustrates a perspective view of the system of the present invention in use on a handbag with a display component firmly secured to a base affixed to the handbag;

FIG. 2 is a detailed view of the system showing the display component removably secured to the base;

FIG. 3 is an additional detailed view of the system showing the display component removed from the base to reveal the attachment mechanisms used to secure the display component to the base;

DETAILED DESCRIPTION OF THE PREFERRED EMBODIMENTS

Figure 4:
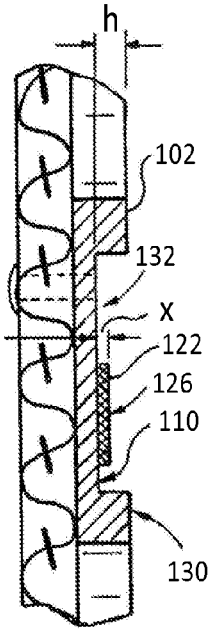
FIG. 4 is a cross-sectional view of the base, illustrating how the base is attached to the handbag or other item.

Reference will now be made in detail to the present preferred embodiments of the invention, examples of which are illustrated in the accompanying drawings. The devices and systems described in this disclosure may be used for removably securing a component to a base. The base may be secured to an item of clothing, or to an accessory, such as a handbag, a shoe, a piece of jewelry, or other similar item. The component may form part of a display or decorative element on the accessory or item of clothing, thus allowing a wearer of the item to remove the component and replace it with another component to quickly change the appearance of the accessory or item of clothing based on a user's preference. For example, the base may comprise a cuff that includes interchangeable decorative components. In another exemplary embodiment, the base may comprises a belt buckle with interchangeable decorative components.

For purposes of explanation and illustration, and not limitation, a system 100 for removably securing a component to a base is shown in FIG. 1. In the exemplary embodiment shown in FIGS. 1-3. System 100 includes a base 102, a display component 104, and attachment mechanisms 106 configured to removably attach display component 104 to base 102. Base 102 may be securely fastened to an item of clothing or to an accessory. In the exemplary embodiment shown in FIGS. 1-3, base 102 is securely fastened to a handbag 108, however, system 100 is not limited to use in this embodiment; the system may be used to attach display component 104 to any suitable object, including an item of clothing such as a shirt, a pair of pants, or a dress, as well as any number of accessories, or even to a wall or other stationary object.

As illustrated in FIG. 3, in one exemplary embodiment, base 102 comprises a planar surface 110 surrounded by a raised lip 112. Base 102 may be made of plastic, metal, a composite, a combination of these materials, or any other suitable material. In one exemplary embodiment, base 102 comprises a zinc or a zinc alloy plated in gold. Base 102 may also include additional decorative elements 114 embedded within lip 112. In one exemplary embodiment, decorative elements 114 comprise crystals or crystal-like materials. Base 102 may be attached to handbag 108 or other item using glue or other suitable adhesive, or using fasteners, stitching, or other suitable means. In one exemplary embodiment, as shown in FIGS. 3-6, base 102 is attached to handbag 108 with a plurality of rivets 116 that extend through base 102 and handbag 108 to permanently attach base 102 to handbag 108. In the exemplary embodiment shown in FIG. 3, base 102 is attached to handbag 108 using five rivets 116 spaced around the perimeter of base 102 in proximity to raised lip 112, however, any suitable number of rivets in any suitable configuration may be used.

As shown in FIGS. 2-6, display component 104 may include a convex upper surface 118 and a planar lower surface 120, and may be configured to securely nest within a recess formed by lip 112 and to be held in place by attachment mechanisms 106. Lip 112 is configured to prevent any slipping of display component 104 when the component is secured to base 102 by attachment mechanisms 106. The combination of attachment mechanisms 106 and lip 112 securely holds display component 104 in place in any orientation. For example, display component 104 will remain firmly in place when handbag 108 is turned sideways or upside down, and will not be dislodged by the movement of handbag 108, including a sudden drop or jarring impact.

In one exemplary embodiment, display component 104 consists of a unique form of artwork. The artwork may be formed on a plastic material that is finished with layers of lacquer and resin, using a process described in U.S. Pat. No. 6,357,152, which is incorporated herein by reference.

In particular, the artwork is constructed in a media that consists of a shaped plastic material. For example, the plastic material may be a material marketed under the trade name Sintra®, which is available from Alusuisse Composites Inc., of Benton, Ky. Sintra® is available in many solid colors, and in thickness stocks of ⅛ of an inch or ¼ of an inch. The artwork used for display component 104 may be hand painted with latex or acrylic paint, and then transformed into a digital image for later use by employing a computer system and associated digital scanner. The digital images generated by the computer system are printed on a high resolution color graphic printer. The printed images are then hand cut and glued to the shaped plastic components with a spray mount adhesive. Digital images bordered by a black line may be spray mounted to black Sintra® material and any perimeter outlining may be carried out using an alcohol base marker. If necessary, the shaped plastic components can be hand painted with latex paint to obtain preferred colors.

Some of the solid color components of the artwork may have complex black line designs, which are hand drawn, digitized, and digitally touched-up using a graphical interface program at high magnification, and subsequently printed on clear acetate sheets. These sheet are then used to make a silk-screen. This is done for some color images and black line images. Some structural components are silk-screened directly, without prior painting, if the stock color of the plastic is acceptable. The decision to use a digital image in the artwork, or a silk-screen image, depends on many factors. In one exemplary embodiment, display components 104 constructed for use with system 100 use a combination of both processes.

Once the imaging process has been completed, display component 104, whether silk-screened, hand painted, hand bordered, or digitally imaged, is coated with lacquer. The lacquer, which may be applied by spray coating, does not adversely react with the imaging paper or the alcohol base marker used to generate the images and artwork for display components 104. It has been found that if the pieces are not sprayed with lacquer, a resin coating used in the assembly process, described below, will tend to have an adverse affect on the images, and the marker will tend to bleed into the clear resin. By coating each structural component with lacquer, each component is sealed so that the resin bonds only with the lacquer coating, not with the underlying image.

The lacquer coating may be applied in at least three layers and all areas to be covered in resin are completely coated. Each layer of lacquer is applied thinly to prevent the images on display component 104 from bleeding, and each layer is allowed to dry for at least 30 minutes before the next layer is applied. Once the desired number of layers has been applied, the display components are left to dry for at least eight hours in a temperature controlled environment, at a temperature of least 70° F. Once dried, the display components are each dusted, touched-up, and checked for spots that were not coated with the lacquer. If necessary, an additional layer of lacquer may be applied to the components.

Display components 104 are then moved to a clean room for the application of the resin material. Preferably, a two-part resin composite is utilized, such as, for example, EnviroTex Lite® high-gloss resin, which is available from Environmental Technology, Inc., of Fields Landing, Calif. The resin bonds with the lacquer coating and serves two distinct functions. First, the resin serves to bond any individual structural components of display component 104 to one another to form a one-piece integral structure, with the components permanently joined together. Second, the resin creates a permanent, durable coating that can be exposed to a normal household environment, and can be cleaned and maintained, without the need of a frame and glass. After the resin is applied, display component 104 is de-gassed and cured in a warm, dust-free room.

In one exemplary embodiment, the unique artwork created by the processes described above is displayed on convex upper surface 118 of display component 104. After display component 104 has been treated with the lacquer and resin, convex upper surface 118 is smooth with rounded edges, thus preventing display component 104 from being easily disengaged when seated within lip 112 of base 102 using attachment mechanisms 106.

In the exemplary embodiment shown in FIGS. 3-6, attachment mechanisms 106 comprise a plurality of magnets. In one exemplary embodiment, shown in FIG. 3, attachment mechanisms 106 comprises one or more pairs of disc magnets, with each pair of magnets including a first magnet 122 and a second magnet 124. First magnet 122 may be permanently affixed to planar surface 110 of base 102 with an upper face 126 of first magnet 122 exposed, and second magnet 124 may be permanently affixed to planar lower surface 120 of display component 104, with a lower face 128 of second magnet 124 exposed. The polarity of the upper face 126 of first magnet 122 and the polarity of lower face 128 of second magnet 124 are opposite such that lower face 128 of second magnet 124 attracts upper face 126 of the corresponding first magnet 122, and when upper face 126 of first magnet 122 contacts lower face 128 of second magnet 124, the strong magnetic force between the two magnets serves to securely, but removably, attach display component 104 to base 102.

In one exemplary embodiment, attachment mechanisms 106 are permanent disc magnets. Such magnets are available, for example, from K&J Magnetics, Inc., of Jamison, Pa. Attachment mechanisms 106 may comprise N52 Neodymium disc magnets. Neodymium magnets are members of the rare earth magnet family and are exceptionally strong. Neodymium magnets may include the elements neodymium, iron, and boron. To strengthen the magnet and protect it from corrosion, the magnet may be coated with nickel, copper, zinc, tin, epoxy, silver, gold, or some combination of these materials in one or more layers. In one exemplary embodiment, three coatings are applied to each magnet. The neodymium magnets used as attachment mechanisms 106 have a high resistance to demagnetization, and will not lose their magnetization when dropped or when they are exposed to other magnets. This property makes them ideal for use in system 100, because accidentally dropping handbag 108 or other item to which base 102 and display component 104 are attached will not result in dislodging display component 104 from base 102 or in damage to the magnets or to system 100.

As shown in FIGS. 3-6, system 100 may include a plurality of disc magnet pairs, with each pair having a first magnet 122 and a second magnet 124. First magnet 122 is affixed to planar surface 110 of base 102 such that upper face 126 of first magnet 122 is a first predetermined distance x from planar surface 110 of base 102. Second magnet 124 is affixed to planar lower surface 120 of display component 104 such that lower face 128 of second magnet 124 is a second predetermined distance y from planar lower surface 120 of display component 104. In one exemplary embodiment, the thickness of first magnet 122 is equal to the first predetermined distance, and the thickness of second magnet 124 is equal to the second predetermined distance. In other words, first magnet 122 is affixed directly to planar surface 110 of base 102 and second magnet 124 is affixed directly to planar lower surface 120 of display component 104. First magnet 122 may be affixed to planar surface 110 of base 102 using glue or any other suitable adhesive; second magnet 124 may be similarly affixed to planar lower surface 120 of display component 104. It is contemplated however, that planar surface 110 and planar lower surface 120 may include recesses or indentations in which magnets 122, 124 are positioned.

Figure 5:
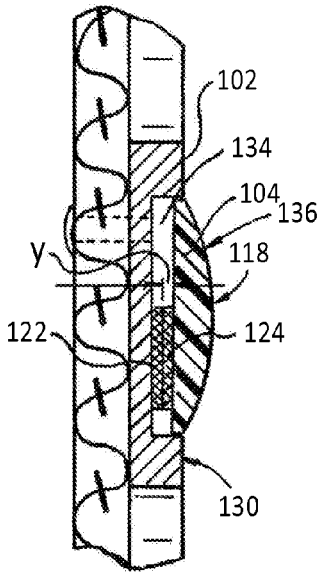
FIG. 5 is an additional cross-sectional view of the system, showing the display component securely engaged with the base.

FIG. 5 illustrates a cross sectional view of magnets 122 and 124 in an engaged position, that is, when upper face 126 of first magnet 122 is in contact with lower face 128 of second magnet 124, and the magnetic force between the two magnets holds the two magnets in a pair together. In one exemplary embodiment, the height of magnets 122 and 124 when engaged, that is the sum of the first predetermined distance x and the second predetermined distance y, is less than the height h of raised lip portion 112 of base 102. Height h of raised lip portion 112 is defined as the distance between planar surface 110 of base 102 and the lowest portion of a top surface 130 of raised lip 112, as shown in FIG. 5. For example, first predetermined distance x may be 1/32 of an inch (0.79 mm), second predetermined distance y may be 1/32 of an inch (0.79 mm), and height h of raised lip portion 112 may be 2.0 mm (0.079 inches). This configuration, along with the rounded edges of display component 104, ensure that display component 104 is securely attached to base 102 and cannot easily be dislodged or accidentally removed from its position. The combination of the strong magnetic force between magnets 122, 124 and raised lip 112 serves to securely hold display component 104 to base 102 regardless of the orientation of base 102.

Advantageously, system 100 also allows a user to easily remove and interchange different display components 104 by creating a leverage point on the display component. In one exemplary embodiment, as shown in FIG. 3, a plurality of magnet pairs comprising first magnet 122 and second magnet 124 are arranged such that a void 132 is created between adjacent magnet pairs. When first magnet 122 and second magnet 124 of each pair are in the engaged position, a gap 134 will be formed directly above void 132 between planar lower surface 120 of display component 104 and planar surface 110 of base 102. The height of gap 134 will be equal to the sum of the height of first predetermined distance x and the second predetermined distance y, or in other words, gap 134 will have a height that is equal to the combined height of first magnet 122 and second magnet 124.

Figure 6:
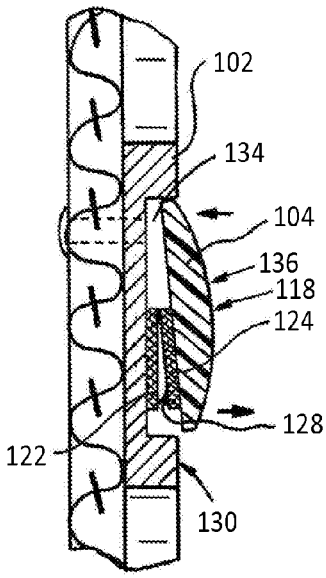
FIG. 6 is yet another cross-sectional view of the system, showing the partial disengagement of the attachment mechanisms on the display component and the base, which allows the display component to be removed from the base.

The area on convex upper surface 118 of display component 104 directly above void 132 creates a leverage point 136. When display component 104 is attached to base 102 by the magnet pairs, a user may apply a downward force to leverage point 136 on convex upper surface 118 of display component 104 in such a way that one or more of first magnets 122 and second magnets 124 at least partially disengage from one another, as shown in FIG. 6, allowing the user to remove display component 104 from base 102 by sliding display component 104 from base 102 or by other means. The term downward force, as used in this application, means a force that has at least a component acting toward the convex upper surface 118 of display component 104 in a direction perpendicular to planar lower surface 120 of display component 104. In other words, it is not necessary that a user apply a force that is completely perpendicular to the planar lower surface of the display component, the user must simply supply a force at the leverage point with a sufficient perpendicular component to allow the magnets to at least partially disengage.

The magnet pairs may be arranged on planar surface 110 of base 102 in any manner that allows formation of void 132 and leverage point 136. As shown in FIG. 3, in one exemplary embodiment, base 102 and display component 104 may be oval shaped, with four disc magnets 122 arranged on around a periphery of the oval shaped base 102. In the embodiment shown, three disc magnets 122 are positioned on planar surface 110 substantially within a lower half of the oval base 102, and one of the disc magnets 122 is positioned substantially within an upper half of the oval base 102. This creates void 132 between magnets 122. In this embodiment, display component 104 includes a corresponding set of magnets 124 positioned on planar lower surface 120 such that each of the magnets 122 on base 102 engages with the corresponding magnet 124 on display component 104. As shown in FIG. 5, applying a downward force at leverage point 136, that is, the point on convex upper surface 118 that is directly above void 132, creates a lever action in display component 104, which disengages first magnet 122 from second magnet 124, as shown in FIG. 6.

Figure 7:
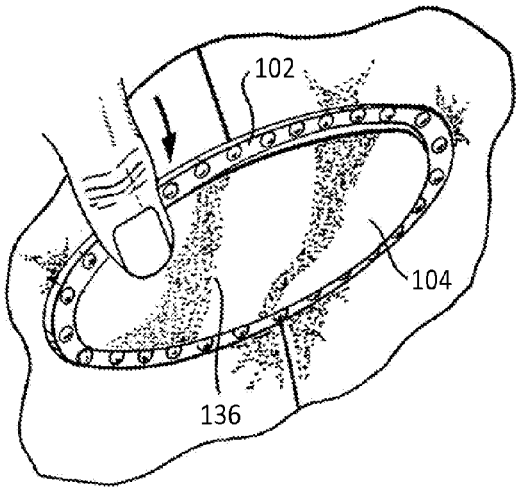
FIG. 7 is a perspective view of the system, illustrating the application of a force to a leverage point on the display component.
Figure 8:
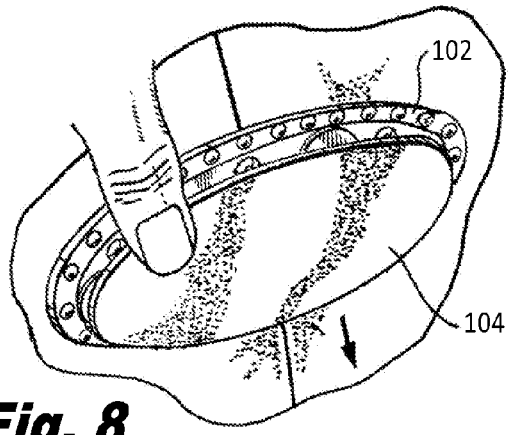
FIG. 8 is an additional perspective view of the system, illustrating the removal of the display component from the base after application of a downward force at the leverage point on the display component.

FIGS. 7 and 8 illustrate the method of applying a downward force to leverage point 136 of display component 104 to partially disengage attachment mechanisms 106 and to allow display component 104 to be removed from base 102. As shown, a user may apply the downward force to leverage point 136 using a thumb or other finger, and then continue application of a force to slide component 104 out of position such that attachment mechanisms 106 disengage and display component can be completely removed from base 102. Advantageously, even when a downward force is applied to leverage point 136, attachment mechanisms 106 will not completely disengage, and display component 104 will remain attached to base 102 until the user continues to apply a force to slide display component 104 from base 102.

Figure 9:
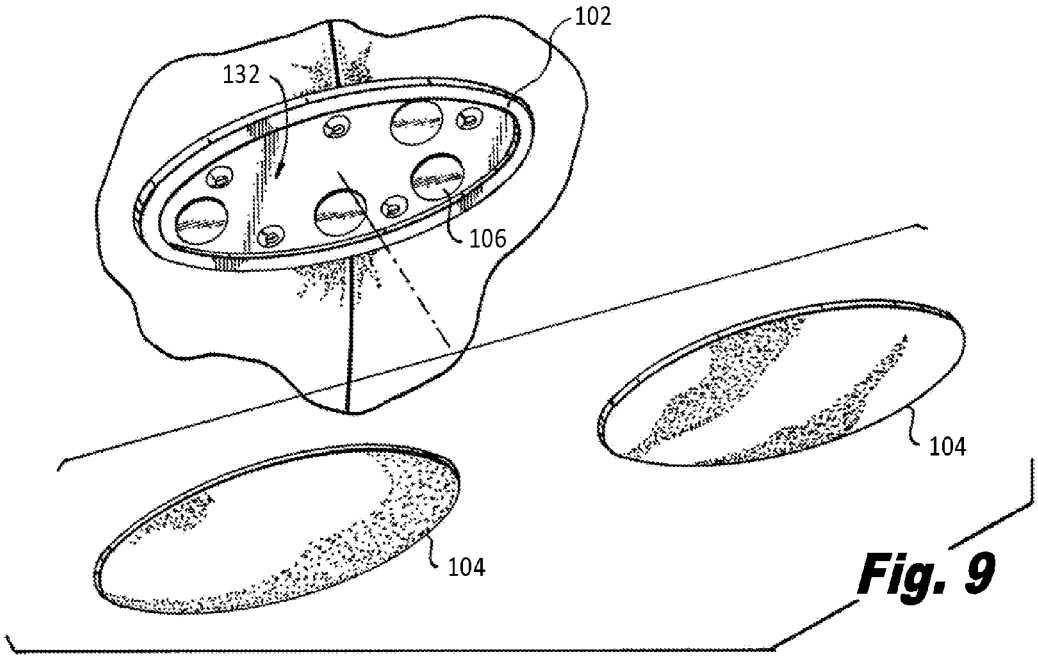
FIG. 9 is a perspective view of the system, illustrating the use of interchangeable display components with the base.

FIG. 9 illustrates the interchangeable feature of system 100. As shown, system 100 may include a plurality of display components 104, each having a different design or a unique piece of artwork, with each display component being configured to securely attach to base 102. In this way, users may customize the item of clothing or accessory to suit their personal tastes.

Figure 10:
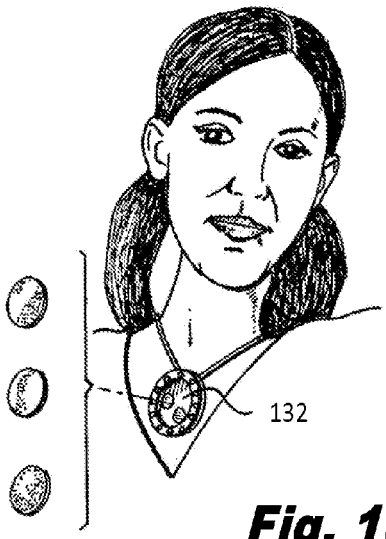
FIG. 10 illustrates an additional exemplary embodiment of the system of the present invention for use with a necklace.
Figure 11:
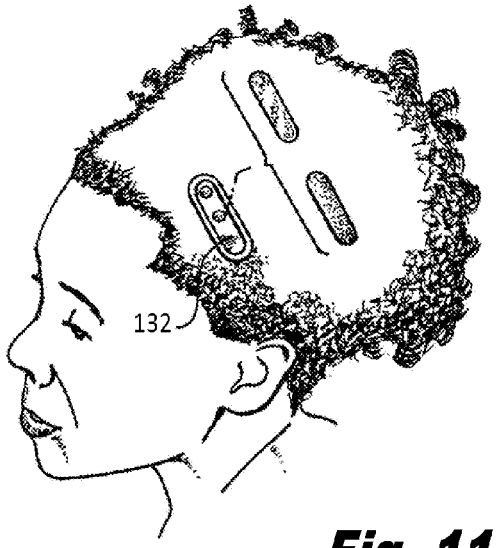
FIG. 11 illustrates an additional exemplary embodiment of the system of the present invention for use with a hair clip or hair band.

Although the exemplary embodiment described above uses an oval-shaped base, an oval-shaped display component, and an arrangement of four magnet pairs, this disclosure contemplates using any suitable shape or size for both base 102 and display component 104, and any suitable arrangement of attachment means 106 that will create the desired void 132 and leverage point 136. For example, a void 132 and corresponding leverage point may be created using only two pairs of magnets, as shown in FIGS. 10 and 11, and may be used in any number of accessories, including a necklace and hair clip, as shown in FIGS. 10 and 11, respectively.

Use of system 100 is not limited to removably securing decorative artwork to an item of clothing or an accessory. System 100 may be used for any application that requires a component be securely and removably attached to a base item. For example, system 100 may be used to secure nametags, nameplates, badges, or other items to a wall or to another object.

While the devices and systems described in this disclosure may be used for removably securing a component to a base have been shown and described with reference to preferred embodiments, those skilled in the art will readily appreciate that various modifications may be made to the disclosed system and structures without departing from the scope of the invention as described in the appended claims and their equivalents.

The invention claimed is:

1. A system for removably securing a component to a base, the system comprising:

a base, having a planar surface and a raised lip portion surrounding the periphery of the planar surface;

a component configured to nest securely within the base surrounded by the raised lip portion;

a first set of permanent magnets fixedly secured to the base in a raised position, wherein an upper face of each of the permanent magnets has a first polarity and is positioned below the raised lip portion of the base;

a second set of permanent magnets fixedly secured to the removable component in a raised position in a configuration corresponding to the first set of permanent magnets, wherein a lower face of each of the magnets in the second set has a second polarity, wherein the second polarity is opposite the first polarity such that the lower face of each magnet in the first set is configured to attract the upper face of the corresponding magnet in the first set of magnets to removably secure the component to the base;

wherein the configuration of the first and the second sets of magnets creates a gap such that depressing the component in the area corresponding to the gap creates a fulcrum allowing the corresponding magnets to at least partially disengage and the component to be removed from the base.

2. The system of claim 1, further comprising a plurality of interchangeable display components configured to nest securely within the base.

* * * * *